US011905960B2

(12) United States Patent
Zhang et al.

(10) Patent No.: US 11,905,960 B2
(45) Date of Patent: Feb. 20, 2024

(54) FAN MOTOR

(71) Applicant: Nidec Corporation, Kyoto (JP)

(72) Inventors: Guiling Zhang, Kyoto (JP); Hidenobu Takeshita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 513 days.

(21) Appl. No.: 17/061,651

(22) Filed: Oct. 2, 2020

(65) Prior Publication Data

US 2021/0018010 A1 Jan. 21, 2021

Related U.S. Application Data

(62) Division of application No. 15/602,198, filed on May 23, 2017, now Pat. No. 10,844,865.

(30) Foreign Application Priority Data

May 24, 2016 (JP) ..... 2016-103170

(51) Int. Cl.
*F04D 25/06* (2006.01)
*F04D 19/00* (2006.01)
(Continued)

(52) U.S. Cl.
CPC ..... *F04D 25/0693* (2013.01); *F04D 19/002* (2013.01); *F04D 29/325* (2013.01); *F04D 29/522* (2013.01)

(58) Field of Classification Search
CPC .. F04D 25/0693; F04D 19/002; F04D 29/325; F04D 29/522; F04D 25/08; F04D 25/0613; H02K 5/225
See application file for complete search history.

(56) References Cited

U.S. PATENT DOCUMENTS 6,174,145 B1 * 1/2001 Taniguchi ..... F04D 25/08 417/423.14
7,811,069 B2 * 10/2010 Fleig ..... F04D 29/526 417/423.15

(Continued)

OTHER PUBLICATIONS

Zhang et al., "Fan Motor", U.S. Appl. No. 15/602,198, filed May 23, 2017.

*Primary Examiner* — Charles G Freay
*Assistant Examiner* — Lilya Pekarskaya
(74) *Attorney, Agent, or Firm* — Keating & Bennett, LLP

(57) ABSTRACT

A fan motor includes a motor including a stationary portion and a rotating portion arranged to rotate about a rotation axis extending in a vertical direction; an impeller including a plurality of blades, and arranged to rotate together with the rotating portion; a housing arranged to house the motor and the impeller therein; and a plurality of lead wires each of which is connected to the motor and is arranged to extend radially outward. The housing includes a tubular portion being tubular, and arranged to extend from an inlet side to an outlet side along the rotation axis, and house at least a portion of the impeller therein; a flange portion arranged to project radially outward from at least a portion of the tubular portion; a lead wire outlet defined in at least a portion of the tubular portion, and arranged to pass through the tubular portion in a radial direction; and a vertical groove arranged to be in communication with the lead wire outlet, and arranged to pass through the flange portion in an axial direction. The flange portion includes a first restricting portion arranged to extend toward the tubular portion. At least one of the lead wires is drawn radially outward through the lead wire outlet, and is held in the vertical groove radially inside of the first restricting portion.

5 Claims, 11 Drawing Sheets

(51) Int. Cl.
*F04D 29/32* (2006.01)
*F04D 29/52* (2006.01)

(56) References Cited

U.S. PATENT DOCUMENTS

2008/0152489 A1* 6/2008 Alex ..... F04D 25/0613
415/213.1
2012/0087813 A1* 4/2012 Yen ..... F04D 29/4206
174/50
2015/0078939 A1* 3/2015 Nishizawa ..... F04D 25/0693
417/423.14
2015/0351280 A1* 12/2015 Gonzalez Inda ..... G06F 1/181
415/126
2016/0138609 A1* 5/2016 Lin ..... F04D 25/0613
415/213.1

* cited by examiner

FAN MOTOR

CROSS REFERENCE TO RELATED APPLICATIONS

This application claims the benefit of priority to Japanese Patent Application No. 2016-103170 filed on May 24, 2016. The entire contents of this application are hereby incorporated herein by reference.

BACKGROUND OF THE INVENTION

1. Field of the Invention

The present invention relates to a fan motor.

2. Description of the Related Art

Axial fan motors arranged to produce axial air flows by rotating impellers using driving forces of motors have been known. The axial fan motors are, for example, installed in household electrical appliances, office automation appliances, transportation equipment, and so on, and are used for the purposes of cooling electronic components, circulating gases in device cases, and so on. In addition, such fan motors are sometimes used for circulating gases in server rooms in which a large number of electronic devices are installed. A known fan motor is described in, for example, CN 103511345A.

The fan motor described in CN 103511345A includes a frame arranged to house a motor and an impeller therein. A first groove, which is defined in the frame, and a second groove, which is defined in a protruding block, are used to hold a power wire connected to a motor, allowing various path arrangements. Thus, this fan motor can be suitable for use with various devices.

However, in the fan motor described in CN 103511345A, the protruding block is so long that the protruding block may be damaged due to insufficient strength when the power wire is drawn out or when the motor is driven.

SUMMARY OF THE INVENTION

A fan motor according to a preferred embodiment of the present invention includes a motor including a stationary portion and a rotating portion arranged to rotate about a rotation axis extending in a vertical direction; an impeller including a plurality of blades, and arranged to rotate together with the rotating portion; a housing arranged to house the motor and the impeller therein; and a plurality of lead wires each of which is connected to the motor and is arranged to extend radially outward. The housing includes a tubular portion being tubular, and arranged to extend from an inlet side to an outlet side along the rotation axis, and house at least a portion of the impeller therein; a flange portion arranged to project radially outward from at least a portion of the tubular portion; a lead wire outlet defined in at least a portion of the tubular portion, and arranged to pass through the tubular portion in a radial direction; and a vertical groove arranged to be in communication with the lead wire outlet, and arranged to pass through the flange portion in an axial direction. The flange portion includes a first restricting portion arranged to extend toward the tubular portion. At least one of the lead wires is drawn radially outward through the lead wire outlet, and is held in the vertical groove radially inside of the first restricting portion.

In the fan motor according to the above preferred embodiment of the present invention, the lead wires, which are drawn out from the motor, can be easily held in the housing. Thus, the likelihood that the lead wires will come off or bend outwardly of the housing can be reduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the accompanying drawings. It is assumed herein that a direction parallel to a rotation axis of a fan motor is referred to by the term "axial direction", "axial", or "axially", that directions perpendicular to the rotation axis of the fan motor are each referred to by the term "radial direction", "radial", or "radially", and that a direction along a circular arc centered on the rotation axis of the fan motor is referred to by the term "circumferential direction", "circumferential", or "circumferentially".

It is also assumed herein that, with respect to an axial direction, a side from which air is taken in (i.e., an upper side in FIG. 1) is referred to as an "inlet side" or simply as an "upper side", and a side toward which the air is discharged (i.e., a lower side in FIG. 1) is referred to as an "outlet side" or simply as a "lower side". Note that the above definitions of the "upper side" and the "lower side" are made simply for the sake of convenience in description, and have no relation to the direction of gravity. Fan motors according to preferred embodiments of the present invention may be used in any orientation.

1. Overall Structure of Fan Motor 1 According to One Preferred Embodiment

Figure 1:
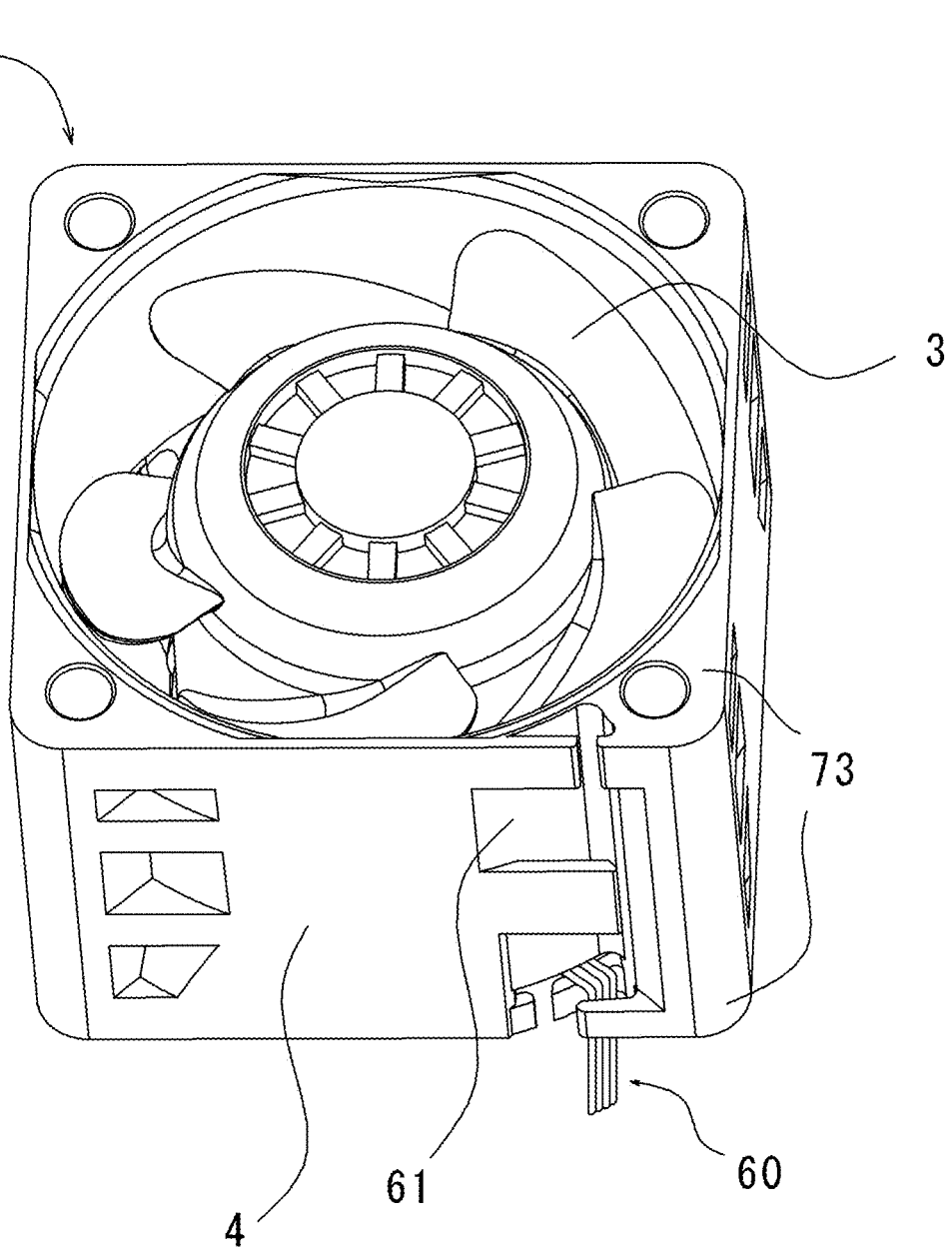
FIG. 1 is a perspective view of a fan motor according to a preferred embodiment of the present invention.
Figure 2:
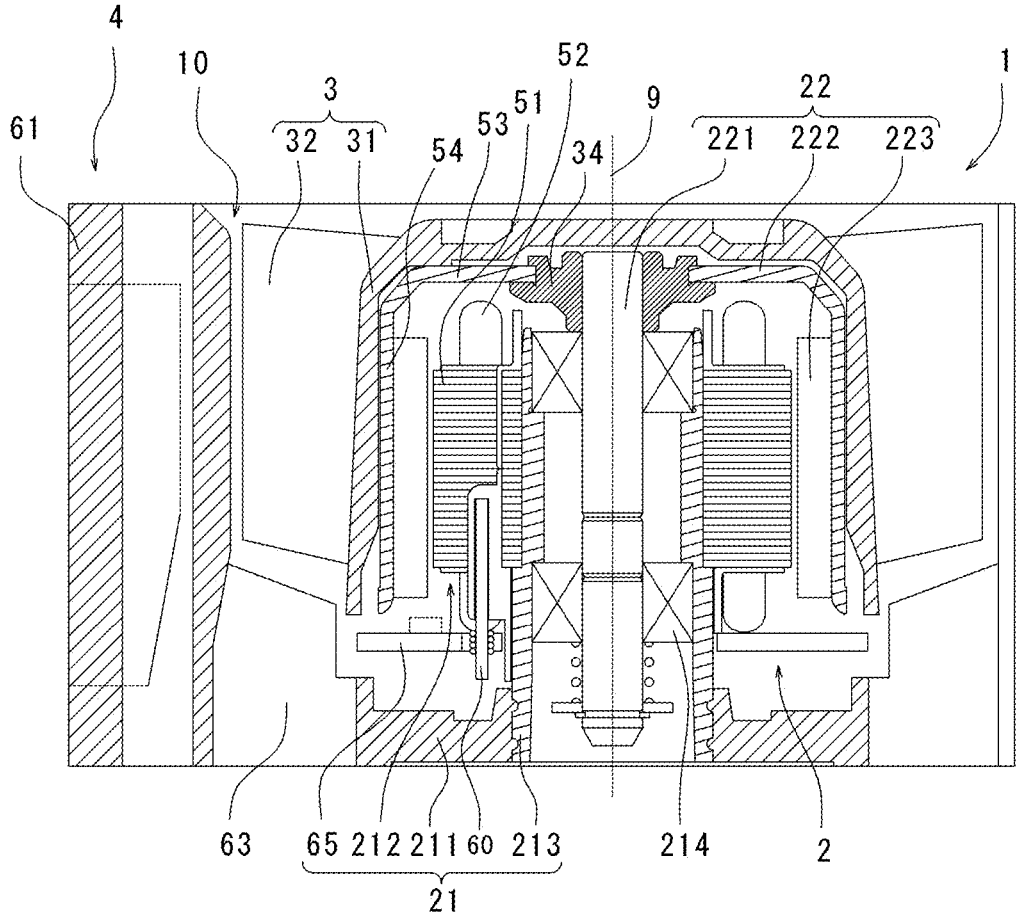
FIG. 2 is a vertical sectional view of the fan motor according to a preferred embodiment of the present invention.

FIG. 1 is a perspective view of a fan motor 1 according to a preferred embodiment of the present invention. FIG. 2 is a vertical sectional view of the fan motor 1 according to a preferred embodiment of the present invention.

The fan motor 1 is used, for example, as an apparatus that supplies a cooling air flow to a household electrical appliance, such as a refrigerator, or an interior of a room, such as a server room, in which a plurality of electronic devices are installed. The fan motor 1 may be used singly, or alternatively, a plurality of fan motors 1 may be used at the same time in combination. For example, a plurality of fan motors 1 may be installed in a single server room, and these fan motors 1 may be driven at the same time.

Referring to FIGS. 1 and 2, the fan motor 1 includes a motor 2, an impeller 3, and a housing 4. In addition, the fan motor 1 includes a plurality of lead wires 60. The fan motor 1 is an axial fan arranged to produce a downward air flow along a rotation axis 9. Once the fan motor 1 is driven, air is taken in from the upper side of the fan motor 1, i.e., from the inlet side, and the air is sent to the lower side of the fan motor 1, i.e., to the outlet side, through a wind channel 10 inside of the housing 4.

The motor 2 includes a stationary portion 21 and a rotating portion 22. The rotating portion 22 is supported to be rotatable with respect to the stationary portion 21. In addition, the rotating portion 22 is arranged to rotate about the rotation axis 9, which extends in a vertical direction.

The stationary portion 21 includes a base portion 211, a stator 212, a bearing holder 213, a circuit board 65, and the lead wires 60. The base portion 211 is a disk-shaped member arranged below the stator 212, and arranged to extend radially outward from an outer circumference of the bearing holder 213. The stator 212 is an armature fixed to an outer circumferential surface of the bearing holder 213. The stator 212 includes a stator core 51 and a plurality of coils 52. The stator core 51 includes a plurality of teeth arranged to extend radially. Each of the coils 52 is defined by a conducting wire wound around a separate one of the teeth.

The bearing holder 213 is a cylindrical member arranged to extend along the rotation axis 9. A lower portion of the bearing holder 213 is fixed to an inner circumferential surface of the base portion 211 through, for example, an adhesive. Bearing portions 214 are arranged radially inside of the bearing holder 213. A ball bearing, for example, is used as each bearing portion 214. An outer race of each bearing portion 214 is fixed to an inner circumferential surface of the bearing holder 213. An inner race of each bearing portion 214 is fixed to a shaft 221, which will be described below, to support the shaft 221. The shaft 221 is thus supported to be rotatable with respect to the stationary portion 21. Note that the motor 2 may alternatively include a bearing portion of another type, such as, for example, a plain bearing or a fluid bearing, in place of the ball bearings.

The rotating portion 22 includes the shaft 221, a rotor holder 222, and a magnet 223. The shaft 221 is a columnar member arranged to extend along the rotation axis 9. The shaft 221 is rotatably supported by the bearing portions 214. While the motor is running, the shaft 221 rotates about the rotation axis 9.

The rotor holder 222 is a member in the shape of a covered cylinder, including a disk-shaped rotor cover portion 53 arranged to extend substantially perpendicularly to the rotation axis 9, and a rotor tubular portion 54 arranged to extend from the rotor cover portion 53 to the outlet side. A metal or a resin, for example, is used as a material of the rotor holder 222. A central portion of the rotor cover portion 53 is fixed to an upper end portion of the shaft 221 through an annular member 34. The rotor holder 222 is thus arranged to rotate together with the shaft 221. The rotor cover portion 53 is arranged on the inlet side of the stationary portion 21. The rotor tubular portion 54 is arranged radially outside of the stator 212. The magnet 223 is fixed to an inner circumferential surface of the rotor tubular portion 54.

The impeller 3 includes a cup portion 31 and a plurality of blades 32. The cup portion 31 is arranged to cover an upper surface and an outer circumferential surface of the rotor holder 222. Each blade 32 is arranged to extend radially outward from an outer circumferential surface of the cup portion 31. The impeller 3 is arranged to rotate together with the rotating portion 22. The blades 32 are arranged at substantially regular intervals in a circumferential direction. Note that the number of blades 32 is not limited to particular values.

The housing 4 is a case arranged to house the motor 2 and the impeller 3 therein. The housing 4 includes a tubular portion 61, a plurality of support portions 63, and flange portions 73.

The tubular portion 61 is tubular, and is arranged to extend along the rotation axis 9. The tubular portion 61 is arranged to extend radially outside of the impeller 3 to substantially assume a cylindrical shape. The tubular portion 61 is arranged to house at least a portion of the impeller 3 therein.

The support portions 63 are arranged to extend radially inward from at least a portion of an inner surface of the tubular portion 61 to be directly or indirectly joined to at least a portion of the stationary portion 21. The stationary portion 21 of the motor 2 is thus positioned with respect to the housing 4. In the present preferred embodiment, the support portions 63 and the tubular portion 61 are defined as a single monolithic member by a resin injection molding process. Note, however, that the support portions 63 and the tubular portion 61 may alternatively be defined by separate members.

The flange portions 73 are arranged to project radially outward from at least portions of the tubular portion 61 at or near an upper end and a lower end of the tubular portion 61. In the present preferred embodiment, the flange portions 73 are arranged at four positions in the circumferential direction. The fan motor 1 is attached to a frame of a household electrical appliance or the like as a result of the flange portions 73 being screwed thereto. Note that the flange portion(s) 73 may alternatively be arranged at or near only one of the upper and lower ends of the tubular portion 61.

Figure 3:
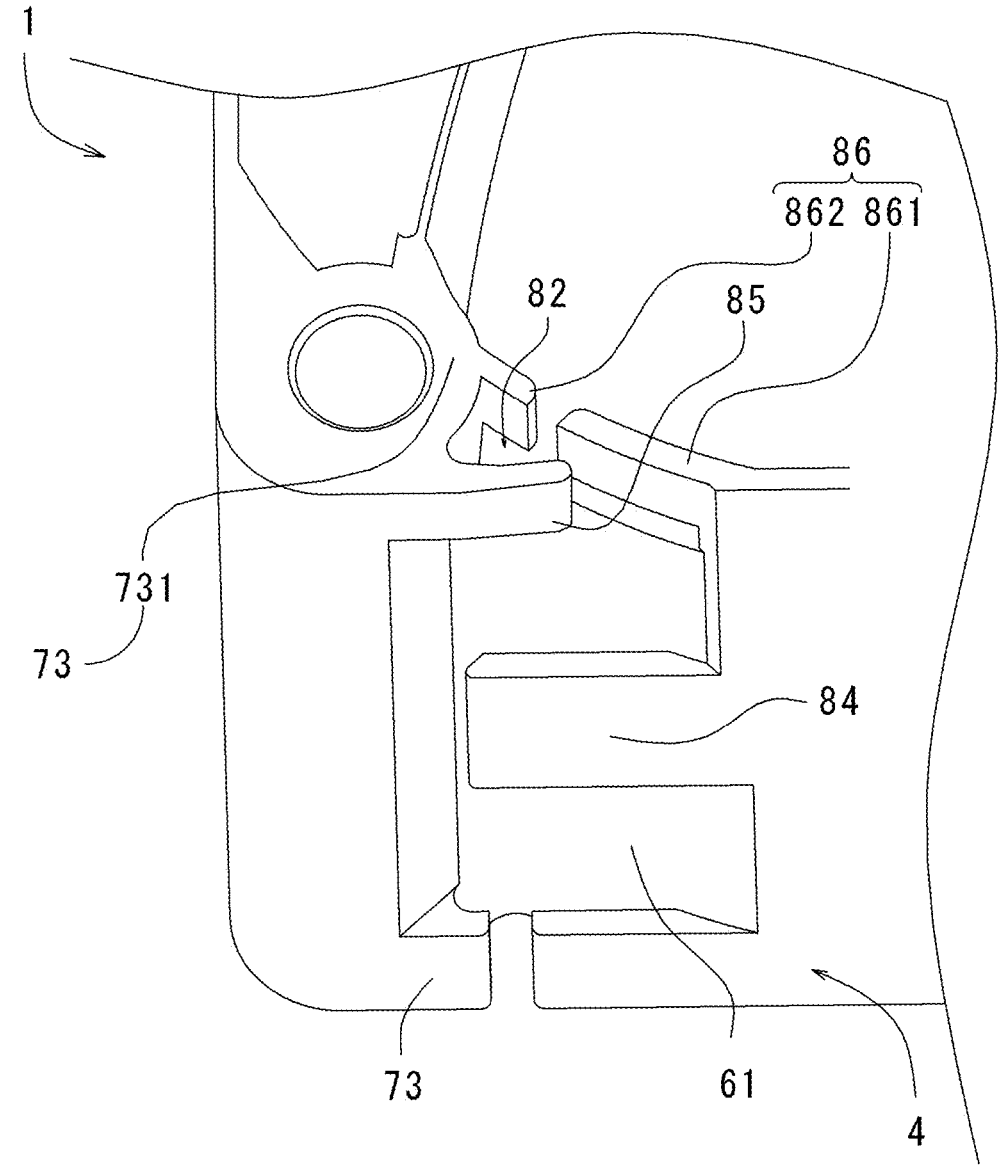
FIG. 3 is a perspective view of a portion of the fan motor according to a preferred embodiment of the present invention.
Figure 4:
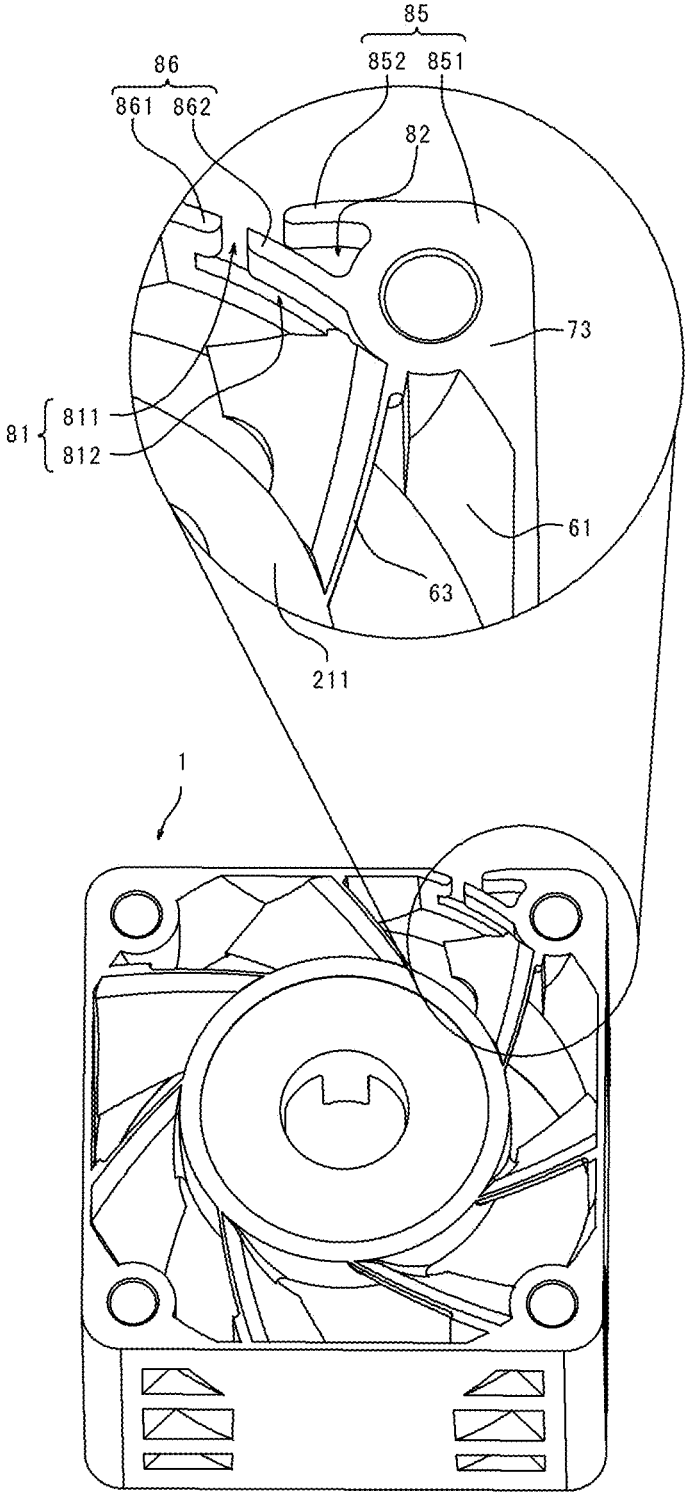
FIG. 4 represents a perspective view of a portion of the fan motor according to a preferred embodiment of the present invention.

1-2. Structure of Portion of Housing 4 Including Lead Wire Outlet 81 and its Vicinity Next, the structure of a portion of the housing 4 of the fan motor 1, the portion including a lead wire outlet 81 and its vicinity, will now be described below. FIG. 3 is a perspective view of a portion of the housing 4 including the lead wire outlet 81 and its vicinity as viewed from the outlet side and radially outside. FIG. 4 is a perspective view of a portion of the housing 4 including the lead wire outlet 81 and its vicinity as viewed from the outlet side and radially inside.

Referring to FIGS. 3 and 4, the lead wire outlet 81, which is defined by a cut, is defined in at least a portion of the tubular portion 61 of the fan motor 1 in the vicinity of the lower end of the tubular portion 61. The lead wire outlet 81 includes a vertical outlet portion 811 arranged to extend axially upward from an axially lower end of the tubular portion 61, and a horizontal outlet portion 812 arranged to extend in the circumferential direction from at least a portion of the vertical outlet portion 811. The vertical outlet portion 811 and the horizontal outlet portion 812 are arranged to intersect each other at right or oblique angles. Although, in FIG. 4, the lead wire outlet 81 is defined by a cut substantially in the shape of the letter "L" when viewed from radially inside, this is not essential to the present invention. For example, the horizontal outlet portion 812 may alternatively be inclined with respect to the circumferential direction, and the vertical outlet portion 811 may alternatively be inclined with respect to the axial direction.

Although, in FIG. 4, the horizontal outlet portion 812 is arranged to cross an upper end portion of the vertical outlet portion 811, this is not essential to the present invention. For example, the horizontal outlet portion 812 may alternatively be arranged to cross an axial middle portion of the vertical outlet portion 811.

The lead wires 60, which are drawn radially outward from the motor 2, are arranged to pass through the lead wire outlet 81. Provision of the horizontal outlet portion 812, which has a circumferential dimension greater than that of the vertical outlet portion 811, makes it easier to hold the lead wires 60 passing through the lead wire outlet 81. In addition, arranging the lead wires 60 to pass through the horizontal outlet portion 812 contributes to preventing the lead wires 60 from coming off downwardly.

The housing 4 further includes a vertical groove 82 arranged to pass through one of the flange portions 73 in the axial direction, and arranged to be in communication with the lead wire outlet 81. The vertical groove 82 is preferably arranged to have a circumferential dimension greater than a circumferential dimension of the lead wire outlet 81. This leads to a sufficient volume of the vertical groove 82 to hold the lead wires 60 therein.

One end of each of the lead wires 60 illustrated in FIG. 1 is electrically connected to the circuit board 65 of the motor 2. Another end of each lead wire 60 is passed through the lead wire outlet 81, which is defined by the cut, of the housing 4, and is then bent downward, for example. When each lead wire 60 is passed through the lead wire outlet 81, the lead wire 60 is first inserted into the vertical outlet portion 811 through a lower end thereof, and is then moved laterally in the circumferential direction into the horizontal outlet portion 812. Thus, improved workability in wiring can be achieved, and the lead wires 60 can be held with increased ease.

Here, the flange portion 73 includes a first restricting portion 85 arranged to extend toward the tubular portion 61. At least one of the lead wires 60 is drawn radially outward through the lead wire outlet 81, and is held in the vertical groove 82 radially inside of the first restricting portion 85. This contributes to preventing the at least one of the lead wires 60 from coming off or bending radially outward.

The first restricting portion 85 includes a base portion 851 and a tip portion 852, and is arranged to slant radially inward as it extends from the base portion 851 to a tip of the tip portion 852. A space in the vertical groove 82 in which the lead wires 60 are held is thus minimized, which contributes to preventing the lead wires 60 from coming off or bending radially outward. Note that the first restricting portion may not be arranged to slant radially inward as in modifications of the present preferred embodiment illustrated in FIGS. 5 and 6, which will be described below.

Meanwhile, the tubular portion 61 has a second restricting portion 86 arranged radially inside of the first restricting portion 85, and arranged radially opposite to the first restricting portion 85 with a gap therebetween. This gap is a portion of the vertical groove 82. Since the lead wires 60 are restricted by a portion other than the first restricting portion 85, the first restricting portion 85 can be designed to have a relatively small length. This will allow both the first and second restricting portions 85 and 86 to be designed to have relatively small lengths, which will lead to improved strength.

Since the second restricting portion 86 is arranged to extend along a circumferential surface of the tubular portion 61, the second restricting portion 86 can be easily molded, which is advantageous.

In addition, the second restricting portion 86 includes a third restricting portion 861 arranged to extend from the tubular portion 61 toward the first restricting portion 85, and a fourth restricting portion 862 arranged to extend from a base portion 731 of the flange portion 73 toward the first restricting portion 85. In this case, the vertical outlet portion 811 is defined between the third and fourth restricting portions 861 and 862. This contributes to preventing the lead wires 60 from coming off toward the wind channel 10 on the radially inner side. Specifically, the lead wires 60, which are drawn out from the motor 2, are drawn radially outward through the lead wire outlet 81. At this time, an axial movement of each lead wire 60 is restricted by the third restricting portion 861 or the fourth restricting portion 862 to allow the lead wire 60 to be easily held. In addition, since each lead wire 60 is held in the horizontal outlet portion 812, which extends in the circumferential direction, a circumferential movement of the lead wire 60 is restricted to allow the lead wire 60 to be easily held. Further, since at least one of the lead wires 60 is held in the vertical groove 82 radially inside of the first restricting portion 85 as described above, the at least one of the lead wires 60 can be prevented from coming off or bending radially outward.

2. Example Modifications

Figure 5:
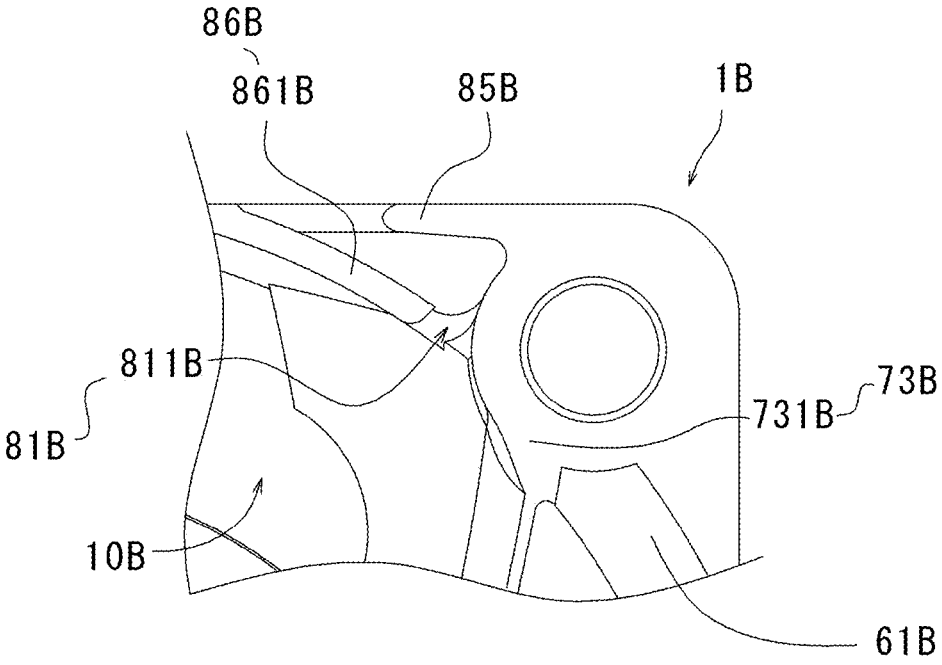
FIG. 5 is a bottom view of a portion of a fan motor according to a modification of the above preferred embodiment.
Figure 6:
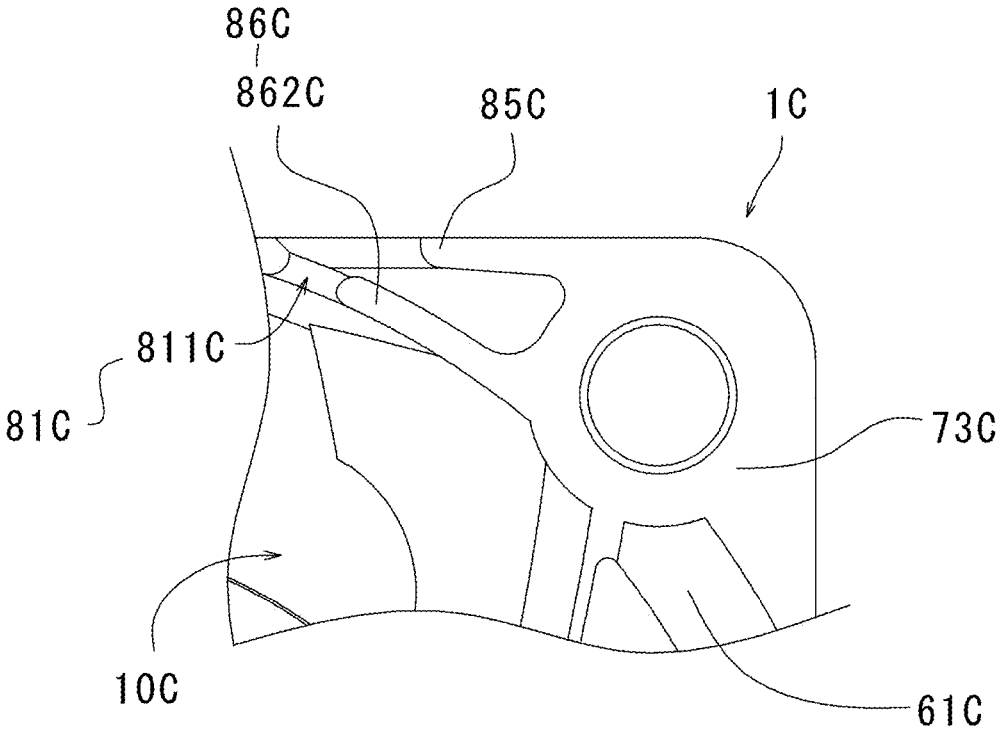
FIG. 6 is a bottom view of a portion of a fan motor according to a modification of the above preferred embodiment.

Next, example modifications of the above-described preferred embodiment will now be described below. Each of FIGS. 5 and 6 is a bottom view of a portion of a housing according to a modification of the above-described preferred embodiment, illustrating a lead wire outlet and its vicinity as viewed from the outlet side. In the modification illustrated in FIG. 5, a second restricting portion 86B is defined by only a third restricting portion 861B. In this modification, a vertical outlet portion 811B is defined between the third restricting portion 861B and a base portion 731B of a flange portion 73B. Thus, a lead wire can be prevented from coming off toward a wind channel 10B defined on the radially inner side. Further, an axial movement of the lead wire can be restricted by the third restricting portion 861B.

In the modification illustrated in FIG. 6, a second restricting portion 86C is defined by only a fourth restricting portion 862C. A vertical outlet portion 811C is defined between the fourth restricting portion 862C and a tubular portion 61C. Thus, a lead wire can be prevented from coming off toward a wind channel 10C defined on the radially inner side. Further, an axial movement of the lead wire can be restricted by the fourth restricting portion 862C.

Figure 7:
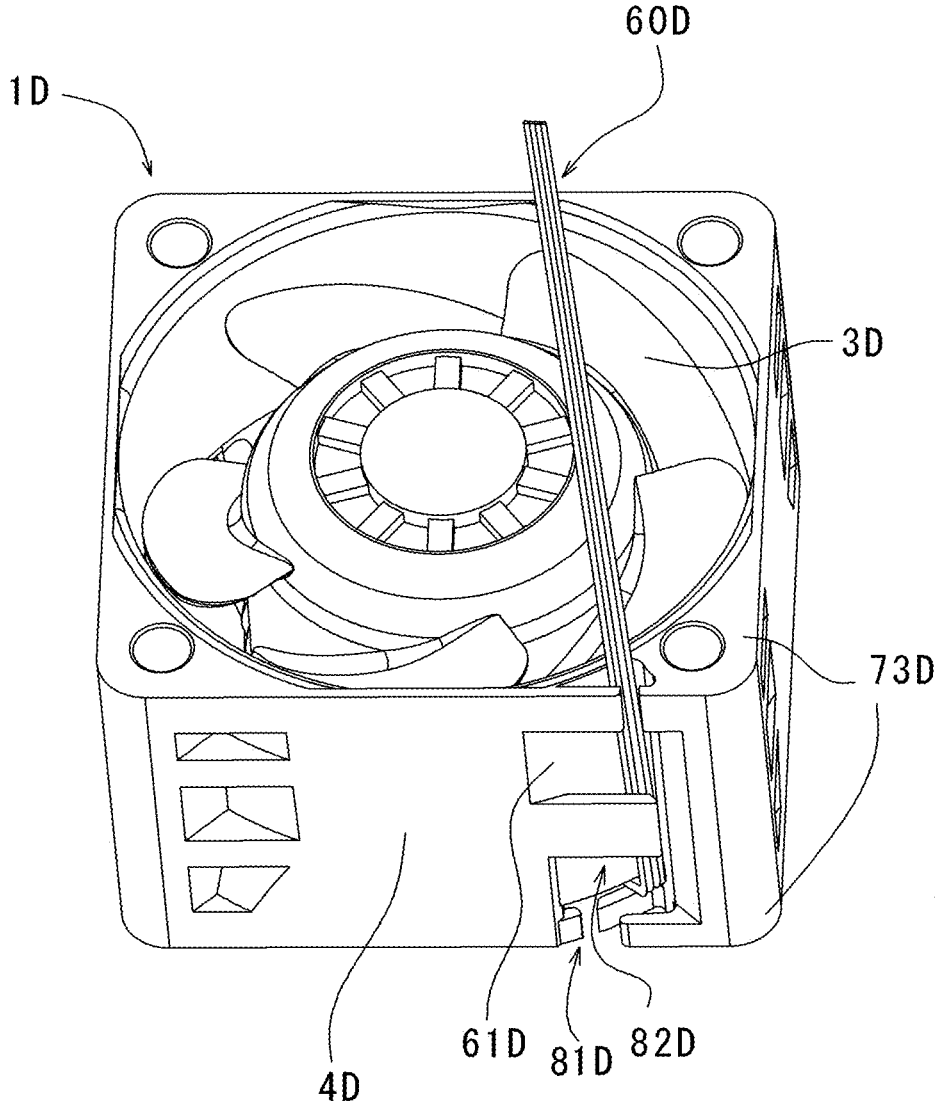
FIG. 7 is a perspective view of a fan motor according to a modification of the above preferred embodiment.

In other modifications of the above-described preferred embodiment, the lead wires may be drawn in different directions. FIG. 7 is a perspective view of a fan motor 1D according to a modification of the above-described preferred embodiment. In this modification, in contrast to the above-described preferred embodiment, at least one of a plurality of lead wires 60D may be arranged to extend toward the inlet side from a vertical groove 82D after passing through a lead wire outlet 81D. This modification is preferable in a case where an object to which the fan motor is connected is located closer to the inlet side than to the outlet side of the fan motor. As described above, fan motors according to preferred embodiments of the present invention are highly versatile.

Figure 8:
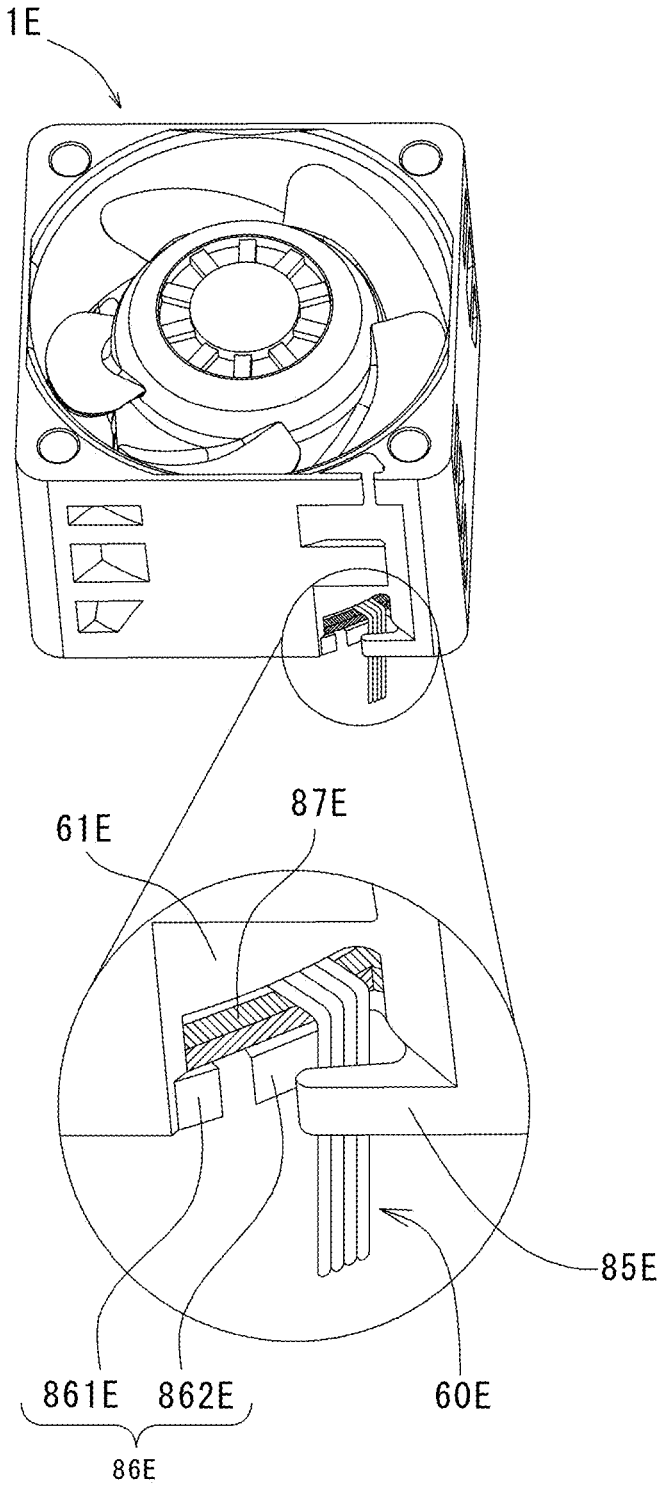
FIG. 8 represents a perspective view of a portion of a fan motor according to a modification of the above preferred embodiment.
Figure 9:
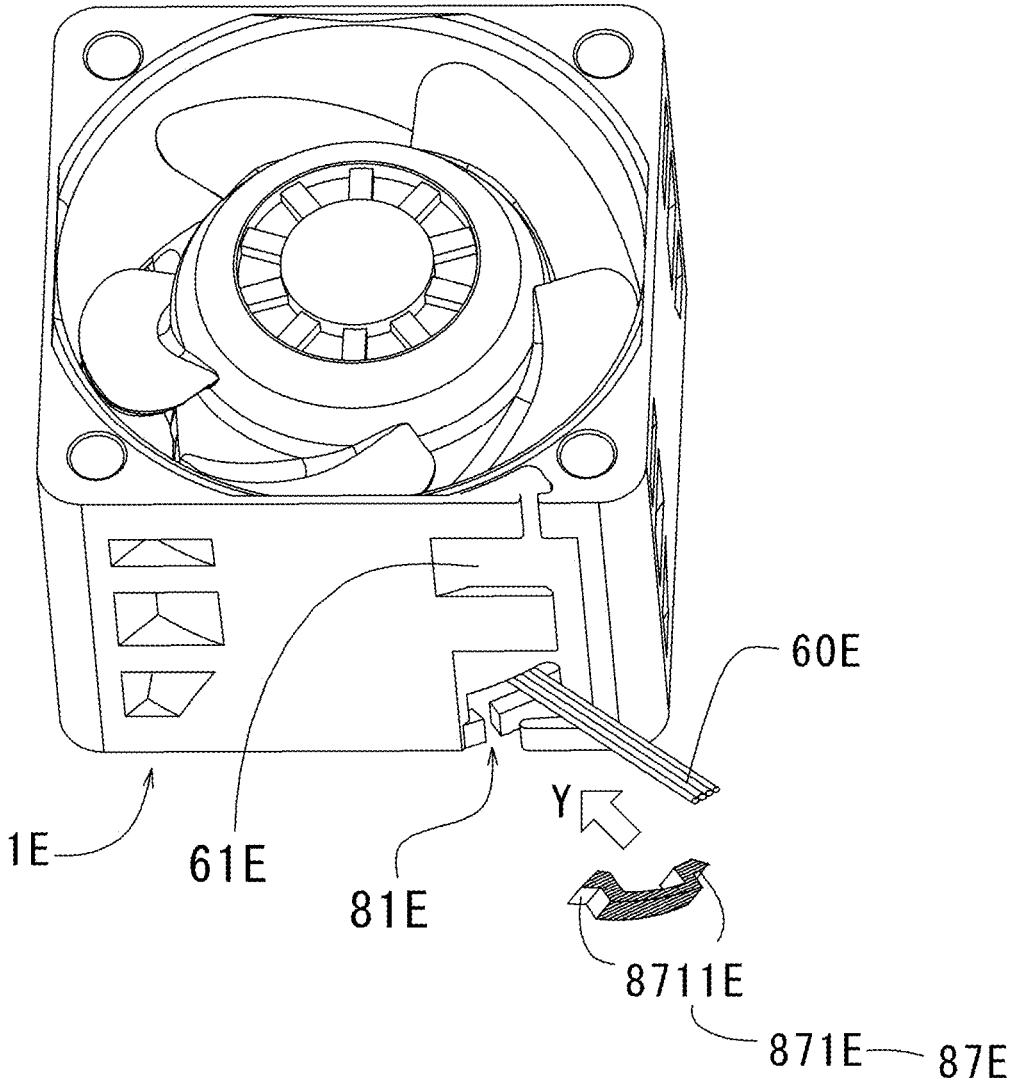
FIG. 9 is a perspective view of the fan motor according to a modification of the above preferred embodiment.
Figure 10:
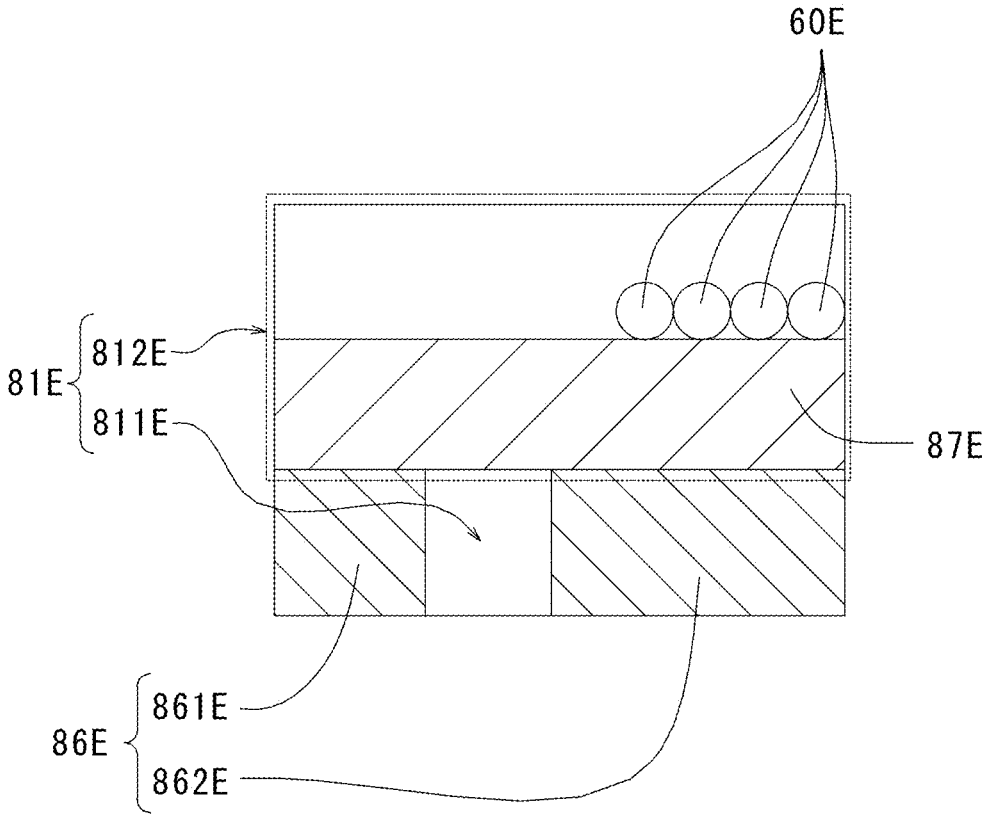
FIG. 10 is a side view of a portion of the fan motor according to a modification of the above preferred embodiment.

Further, a fan motor 1E according to a modification of the above-described preferred embodiment of the present invention may include a clip 87E arranged to cover a portion of a lead wire outlet 81E. Here, "to cover . . . " means that the clip 87E reduces the area of a radially outward opening of the lead wire outlet 81E. Each of FIGS. 8 and 9 is a perspective view of the fan motor 1E according to a modification of the above-described preferred embodiment, illustrating the lead wire outlet 81E of a housing and its vicinity as viewed from the inlet side. Each of FIGS. 10 and 11 is a side view of a portion of the fan motor 1E, illustrating the lead wire outlet 81E of the housing and its vicinity as viewed from a direction indicated by arrow Y in FIG. 9.

Referring to FIG. 9, the clip 87E includes, at circumferential end portions thereof, engagement portions 8711E arranged to be engaged with an inner circumferential surface of a tubular portion 61E. After lead wires 60E are drawn out radially outward, the clip 87E is moved in the direction indicated by arrow Y from the outlet side of the lead wires 60E to be engaged with the inner circumferential surface of the tubular portion 61E. Thus, each lead wire 60E can be prevented from coming off toward a wind channel defined on the radially inner side through the lead wire outlet 81E.

Further, since the clip 87E reduces the area of a radially outward opening of the wind channel, the fan motor 1E is able to achieve improved air volume characteristics and improved static pressure characteristics. FIG. 10 is a side view of a portion of the fan motor 1E as viewed from the direction indicated by arrow Y in FIG. 9. A portion of a radially outward opening of a horizontal outlet portion 812E, which is indicated by a broken line, is covered by the clip 87E. It is preferable that a half or more of the radially outward opening of the horizontal outlet portion 812E is covered by the clip 87E.

Figure 11:
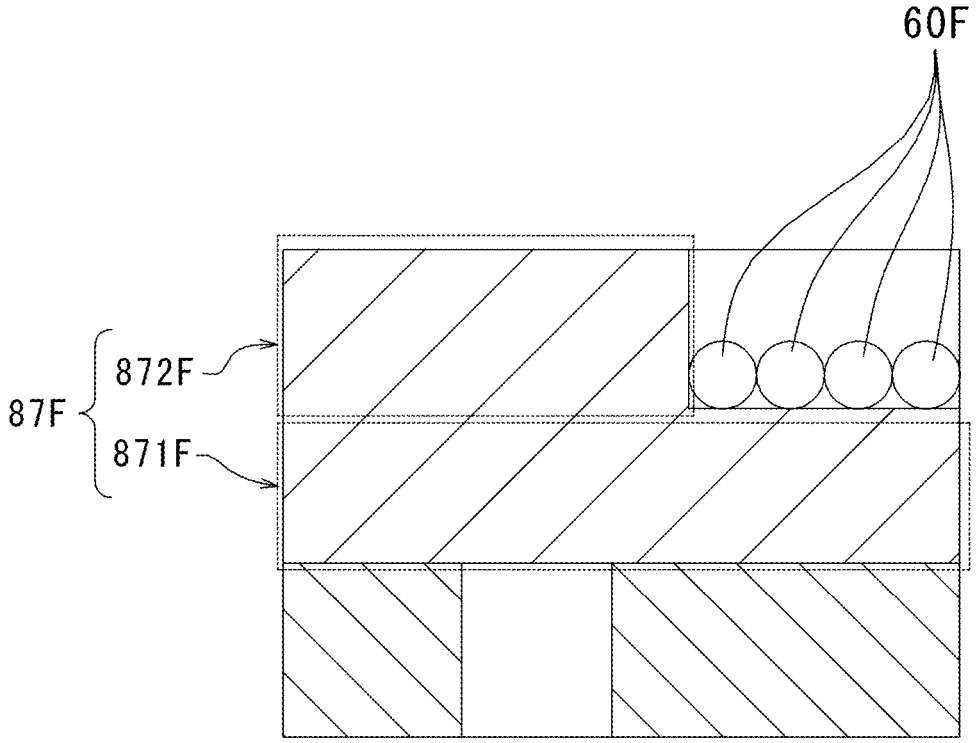
FIG. 11 is a side view of a portion of a fan motor according to a modification of the above preferred embodiment.

In a modification of the above-described preferred embodiment, a clip 87F may include a body portion 871F arranged to cover a portion of a lead wire outlet on the lower side of lead wires 60F, and a projecting portion 872F arranged to project upward from the body portion 871F, as indicated by broken lines in FIG. 11. In this modification, a space in which the lead wires 60F are held is minimized to reduce the area of a radially outward opening of a wind channel, and thus, a fan motor according to this modification is able to achieve improved air volume characteristics and improved static pressure characteristics. Note that use of the clip to reduce the area of the radially outward opening of the wind channel is not essential to the present invention. A resin, such as, for example, a sealant, may alternatively be used for that purpose. Also note that the clip may alternatively be attached from inside the tubular portion.

While preferred embodiments of the present invention have been described above, it will be understood that the present invention is not limited to the above-described preferred embodiments.

For example, the lead wire outlet and the vertical groove of the housing may be arranged on the inlet side instead of or as well as on the outlet side. For example, in a case where a board of the motor is arranged on the inlet side, it is desirable that the lead wire outlet and the vertical groove of the housing be arranged on the inlet side.

Note that details of the shape of a fan motor according to a preferred embodiment of the present invention may differ from details of the shape of each of the fan motors as illustrated in the accompanying drawings of the present application. Also note that features of the above-described preferred embodiments and the modifications thereof may be combined appropriately as long as no conflict arises.

Preferred embodiments of the present invention are applicable to, for example, fan motors.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fan motor comprising:

a motor including a stationary portion and a rotating portion arranged to rotate about a rotation axis extending in a vertical direction;

an impeller, including a plurality of blades, is arranged to rotate together with the rotating portion;

a housing arranged to house the motor and the impeller therein;

lead wires, each of which is connected to the motor and is arranged to extend radially outward; and a clip; wherein the housing includes:

a tubular portion being tubular, and arranged to extend from an inlet side to an outlet side along the rotation axis, and house at least a portion of the impeller therein;

a flange portion arranged to project radially outward from at least a portion of the tubular portion;

a lead wire outlet defined in at least a portion of the tubular portion, and arranged to pass through the tubular portion in a radial direction; and a vertical groove arranged to be in communication with the lead wire outlet, and arranged to pass through the flange portion in an axial direction;

the flange portion includes a first restricting portion arranged to extend toward the tubular portion;

at least one radially extending lead wire of the lead wires is drawn radially outward through the lead wire outlet, and is held in the vertical groove radially inside of the first restricting portion; and the clip is attached to the housing such that the clip covers some of a radially extending opening portion of the lead wire outlet which is axially above or axially below the lead wires; and the clip closes a radially outermost portion of some of the radially extending opening portion of the lead wire outlet.

2. The fan motor according to claim 1, wherein at least one downwardly extending lead wire of the lead wires is arranged to extend downward from the vertical groove.

3. The fan motor according to claim 1, wherein the clip includes:

a body portion arranged to cover an axially extending portion of the lead wire outlet on a lower axial side of the lead wires; and a projecting portion arranged to project upward from the body portion.

4. The fan motor according to claim 1, wherein at least a portion of the clip overlaps an axially uppermost or axially lowermost end of the vertical groove when the fan motor is viewed in the vertical direction.

5. The fan motor according to claim 4, wherein the at least the portion of the clip which overlaps the axially uppermost or axially lowermost end of the vertical groove when the fan motor is viewed in the vertical direction is directly adjacent to the axially uppermost or axially lowermost end of the vertical groove in the vertical direction.

* * * * *